US008153997B2

(12) United States Patent
Norling et al.

(10) Patent No.: US 8,153,997 B2
(45) Date of Patent: Apr. 10, 2012

(54) ISOTOPE PRODUCTION SYSTEM AND CYCLOTRON

(75) Inventors: Jonas Norling, Uppsala (SE); Tomas Eriksson, Uppsala (SE)

(73) Assignee: General Electric Company, Schenectady, NY (US)

( * ) Notice: Subject to any disclaimer, the term of this patent is extended or adjusted under 35 U.S.C. 154(b) by 198 days.

(21) Appl. No.: 12/435,903

(22) Filed: May 5, 2009

(65) Prior Publication Data

US 2010/0282978 A1 Nov. 11, 2010

(51) Int. Cl.
*H05H 13/00* (2006.01)
*G21K 5/00* (2006.01)
*H01J 33/02* (2006.01)

(52) U.S. Cl. ..... 250/492.3; 250/396 ML; 315/502; 313/62

(58) Field of Classification Search ..... None
See application file for complete search history.

(56) References Cited

U.S. PATENT DOCUMENTS

| | | | |
|---|---|---|---|
| 2,713,635 | A | 7/1955 | Weissenberg et al. |
| 2,872,574 | A | 2/1959 | McMillan et al. |
| 3,175,131 | A | 3/1965 | Burleigh et al. |
| 3,786,258 | A | 1/1974 | Schmidt |
| 3,794,927 | A | 2/1974 | Fleischer et al. |
| 3,921,019 | A | 11/1975 | Karasawa |
| 3,925,676 | A | 12/1975 | Bigham et al. |
| 4,007,392 | A | 2/1977 | Valfells |
| 4,139,777 | A | 2/1979 | Rautenbach |
| 4,153,889 | A | 5/1979 | Ikegami |
| 4,288,289 | A | 9/1981 | Landau |
| 5,139,731 | A | 8/1992 | Hendry |
| 5,463,291 | A | 10/1995 | Carroll et al. |
| 5,646,488 | A | 7/1997 | Warburton |
| 5,874,811 | A | 2/1999 | Finlan et al. |
| 5,917,874 | A | 6/1999 | Schlyer et al. |
| 6,057,655 | A | 5/2000 | Jongen |
| 6,163,006 | A | 12/2000 | Doughty |
| 6,236,055 | B1 | 5/2001 | Williams et al. |

(Continued)

FOREIGN PATENT DOCUMENTS

GB 645758 11/1950

(Continued)

OTHER PUBLICATIONS

E. Hartwig, "The AEG compact cyclotron", Proceedings of the Fifth international Cyclotron Conference, 1971, pp. 564-572, XP002599602.

(Continued)

*Primary Examiner* — Jack Berman
(74) *Attorney, Agent, or Firm* — The Small Patent Law Group; Dean D. Small

(57) ABSTRACT

A cyclotron that includes a magnet yoke having a yoke body that surrounds an acceleration chamber. The cyclotron also includes a magnet assembly to produce magnetic fields to direct charged particles along a desired path. The magnet assembly is located in the acceleration chamber. The magnetic fields propagate through the acceleration chamber and within the magnet yoke, wherein a portion of the magnetic fields escapes outside of the magnet yoke as stray fields. The cyclotron also includes a vacuum pump that is coupled to the yoke body. The vacuum pump is configured to introduce a vacuum into the acceleration chamber. The magnet yoke is dimensioned such that the vacuum pump does not experience magnetic fields in excess of 75 Gauss.

24 Claims, 12 Drawing Sheets

U.S. PATENT DOCUMENTS

| | | | | |
|---|---|---|---|---|
| 6,392,246 | B1 | 5/2002 | Wiberg et al. | |
| 6,417,634 | B1 | 7/2002 | Bergstrom | |
| 6,433,495 | B1 | 8/2002 | Wiberg | |
| 6,445,146 | B1 | 9/2002 | Bergstrom et al. | |
| 6,657,188 | B1 | 12/2003 | Hulet et al. | |
| 6,683,426 | B1 | 1/2004 | Kleeven | |
| 6,917,044 | B2 | 7/2005 | Amini | |
| 7,030,399 | B2 | 4/2006 | Williamson et al. | |
| 7,122,966 | B2 | 10/2006 | Norling | |
| 7,394,081 | B2 | 7/2008 | Okazaki et al. | |
| 7,541,905 | B2 | 6/2009 | Antaya | |
| 7,728,311 | B2 | 6/2010 | Gall | |
| 2004/0120826 | A1 | 6/2004 | Perkins et al. | |
| 2005/0084055 | A1 | 4/2005 | Alvord et al. | |
| 2005/0283199 | A1 | 12/2005 | Norling et al. | |
| 2006/0015864 | A1 | 1/2006 | Kang | |
| 2006/0104401 | A1 | 5/2006 | Jongen | |
| 2007/0171015 | A1 | 7/2007 | Antaya | |
| 2007/0176699 | A1 | 8/2007 | Iida et al. | |
| 2008/0023645 | A1 | 1/2008 | Amelia et al. | |
| 2008/0067413 | A1 | 3/2008 | Nutt | |
| 2008/0093567 | A1 | 4/2008 | Gall | |
| 2008/0240330 | A1 | 10/2008 | Holden | |
| 2008/0258653 | A1 | 10/2008 | Nutt | |
| 2009/0200483 | A1 | 8/2009 | Gall et al. | |
| 2010/0282978 | A1 | 11/2010 | Norling et al. | |
| 2010/0282979 | A1 * | 11/2010 | Norling et al. | 250/396 ML |
| 2010/0283371 | A1 | 11/2010 | Norling et al. | |
| 2010/0329406 | A1 | 12/2010 | Norling et al. | |

FOREIGN PATENT DOCUMENTS

| | | |
|---|---|---|
| GB | 756872 | 12/1956 |
| JP | 200223740 | 8/2002 |
| JP | 200512790 | 5/2005 |
| RU | 2278431 | 1/2006 |
| WO | 2006007277 | 1/2006 |
| WO | 2006012467 | 2/2006 |
| WO | 2006015864 | 2/2006 |

OTHER PUBLICATIONS

A.I. Papash & Yu G. Alenitsky, "Commercial Cyclotrons, Part I: commercial Cyclotrons in the Energy Range 10-30 MeV for Isotope Production", Physics of Particles and Nuclei, 2008, pp. 597-631, XP002599603, Dubna, Russia.

Y. Jongen & G. Ryckewaert, "Preliminary Design for a 30 MeV, 500 MicroA H- Cyclotron", IEEE Transactions on Nuclear Science, vol. NS-32, No. 5, Oct. 1985, pp. 2703-2705, XP002599604, Louvain-la-Neuve, belgium.

International Search Report and Written Opinion issued in connection with PCT/US2010/028090, Sep. 20, 2010.

V.U. Heidelberger et al., First Experience With the Vacuum System of the Cycloton Comet, PSA Scientific and Technical Report 2004 / vol. VI, pp. 118, 119.

Bruce F. Milton, Commercial Compact Cyclotrons in the 90's, TRIUMF, 4004 Westbrook Mall, Vancouver, B.C. Canada V6T 2A3, 8 pgs.

K. Strijckmans, The Isochronous Cyclotron: Principles and Recent Developments, *Computerized Medical Imaging and Graphics*, 25 (2001) 69-78, www.elsevier.com/locate/compmedimag.

Electron and Gamma Bremsstrahlung Beams of JINR and CTU Microtrons. Belov A.G. (JINR, Dubna) Chvatil D. et al; 1 pg., 2000.

Marks, Steve; Magnetic Design of Trim Exitations for the Advanced Light Source Storage Ring Sextupole*, Advanced Light Source Accelerator and Fusion Research Division Lawrence Berkeley Laboratory, Univ. of California, Jun. 1995, 8 pgs.

Kalt, U et al; Vacuum System of the Proscan Cyclotron Comet; PSI Scientific and Technical Report 2002, vol. 6, 1 pg.

Kjellstrom, R. et al; MC32 Multiparticle Negative ION Cyclotron; Nuclear Medicine Division, 6 pgs., 1989.

Michelato, P. et al; Operational Experience of the K800 Cyclotron Vacuum System at LNS; 3 pgs., 1992.

Ohnishi, J. et al; The Magnetic Field of the Superconducting Ring Cyclotron, 3 pgs., 2007.

Berridge, MS et al; High Yield 0-18 Water Target for F-18 Production on MC-17 Cyclotrons, 4 pgs., 2002.

Hichwa, RD et al; Design of Target Systems for Production of PET Nuclides; Division of Nuclear Medicine 1989, 4pgs.

H. Okuno et al; The Superconducting Ring Cyclotron in RIKEN, IEEE Transactions on Applied Superconductivity IEEE USA, vol. 17 No. 2; pp. 1063-1068, Jun. 2007, Japan.

Chouhan, et al; Design of Superferric Magnet for the Cyclotron Gas Stopper Project at the NSCL*; Proceedings of PAC07, Albuquerque, New Mexico, USA, 1-4244-0917-9/07 c 2007 IEEE.

Dehnel et al; The TRI 6/8, A Dual Particle Cyclotron for Clinical Isotope Production; 3pgs., 1992.

International Search Report and Written Opinion issued in connection with PCT/US2010/031394, Sep. 21, 2010.

International Search Report and Written Opinion issued in connection with PCT/US2010/037258, Oct. 14, 2010.

International Search Report and Written Opinion issued in connection with PCT/US2010/028573, Sep. 28, 2010.

* cited by examiner

ISOTOPE PRODUCTION SYSTEM AND CYCLOTRON

CROSS-REFERENCES TO RELATED APPLICATIONS

The present application includes subject matter related to subject matter disclosed in U.S. application Ser. No. 12/435,931 (Publ. No. 2010-0283371A1), which is entitled "ISOTOPE PRODUCTION SYSTEM AND CYCLOTRON HAVING REDUCED MAGNETIC STRAY FIELDS," and also in U.S. application Ser. No. 12/435,949 (Publ. No. 2010-0282979A1), which is entitled "ISOTOPE PRODUCTION SYSTEM AND CYCLOTRON HAVING A MAGNET YOKE WITH A PUMP ACCEPTANCE CAVITY," filed contemporaneously with the present application, both of which are incorporated by reference in their entirety.

BACKGROUND OF THE INVENTION

Embodiments of the invention relate generally to cyclotrons, and more particularly to cyclotrons used to produce radioisotopes.

Radioisotopes (also called radionuclides) have several applications in medical therapy, imaging, and research, as well as other applications that are not medically related. Systems that produce radioisotopes typically include a particle accelerator, such as a cyclotron, that accelerates a beam of charged particles and directs the beam into a target material to generate the isotopes. The cyclotron uses electrical and magnetic fields to accelerate and guide the particles along a spiral-like orbit within an acceleration chamber. When the cyclotron is in use, the acceleration chamber is evacuated to remove undesirable gas particles that can interact with the accelerated particles. For example, when the accelerated particles are negative hydrogen ions ($H^-$), hydrogen gas molecules ($H_2$) or water molecules within the acceleration chamber can strip the weakly bound electron from the hydrogen ion. When the ion is stripped of this electron it becomes a neutral particle that is no longer affected by the electrical and magnetic fields within the acceleration chamber. The neutral particle is irretrievably lost and may also cause other undesirable reactions within the acceleration chamber.

To maintain the evacuated state of the acceleration chamber, cyclotrons use vacuum systems that are fluidicly coupled to the chamber. However, conventional vacuum systems may have undesirable qualities or properties. For example, conventional vacuum systems can be large and require extensive space. This may be problematic, especially when the cyclotron and vacuum system must be used in a hospital room that was not originally designed for using large systems. Furthermore, existing vacuum systems typically have several interconnected components, such as a number of pumps (including different types of pumps), valves, pipes, and clamps. In order to effectively operate the vacuum system, it may be necessary to monitor each component (e.g., through sensors and gauges) and to individually control some of these components. Furthermore, with several interconnected components there may be more interfaces or regions where leaks may occur due to damaged or worn-out parts. This may lead to costly and time-consuming maintenance of the vacuum system.

In addition to the above, conventional vacuum systems may use diffusion pumps. For example, in one known vacuum system, several diffusion pumps are fluidicly coupled to the acceleration chamber. The diffusion pumps use a working fluid (e.g., oil) to generate a vacuum by boiling the oil to a vapor and directing the vapor through a jet assembly. However, the oil within the diffusion pumps may backstream into the acceleration chamber of the cyclotron. This may reduce the vacuum system's ability to remove the gas particles, which, in turn, may negatively affect the efficiency of the cyclotron. Furthermore, oil within the acceleration chamber may induce electrical discharges that damage the electrical components used by the cyclotron to create the electrical field.

Accordingly, there is a need for improved vacuum systems that remove undesirable gas particles from the acceleration chamber. There is also a need for vacuum systems that require less space, require less maintenance, are less complex, or are less costly than known vacuum systems.

BRIEF DESCRIPTION OF THE INVENTION

In accordance with one embodiment, a cyclotron is provided that includes a magnet yoke having a yoke body that surrounds an acceleration chamber. The cyclotron also includes a magnet assembly to produce magnetic fields to direct charged particles along a desired path. The magnet assembly is located in the acceleration chamber. The magnetic fields propagate through the acceleration chamber and within the magnet yoke, wherein a portion of the magnetic fields escapes outside of the magnet yoke as stray fields. The cyclotron also includes a vacuum pump that is directly coupled to the yoke body. The vacuum pump is configured to introduce a vacuum into the acceleration chamber. The magnet yoke is dimensioned such that the vacuum pump does not experience magnetic fields in excess of 75 Gauss.

In accordance with another embodiment, a cyclotron is provided that includes a magnet yoke having a yoke body that surrounds an acceleration chamber. The cyclotron also includes a magnet assembly to produce magnetic fields to direct charged particles along a desired path. The magnet assembly is located in the acceleration chamber. The magnetic fields propagate through the acceleration chamber and within the magnet yoke, wherein a portion of the magnetic fields escapes outside of the magnet yoke as stray fields. The cyclotron also includes a vacuum pump that is directly coupled to the yoke body. The vacuum pump is configured to introduce a vacuum into the acceleration chamber. The vacuum pump is a fluidless pump that has a rotating fan to produce the vacuum.

In accordance with yet another embodiment, an isotope production system is provided that includes a magnet yoke having a yoke body that surrounds an acceleration chamber. The isotope production system also includes a magnet assembly to produce magnetic fields to direct charged particles along a desired path. The magnet assembly is located in the acceleration chamber. The magnetic fields propagate through the acceleration chamber and within the magnet yoke, wherein a portion of the magnetic fields escapes outside of the magnet yoke as stray fields. The isotope production system also includes a vacuum pump that is directly coupled to the yoke body. The vacuum pump is configured to introduce a vacuum into the acceleration chamber. The magnet yoke is dimensioned such that the vacuum pump does not experience magnetic fields in excess of 75 Gauss. The isotope production system also includes a target system that is positioned to receive the charged particles for generating isotopes.

DETAILED DESCRIPTION OF THE INVENTION

Figure 1:
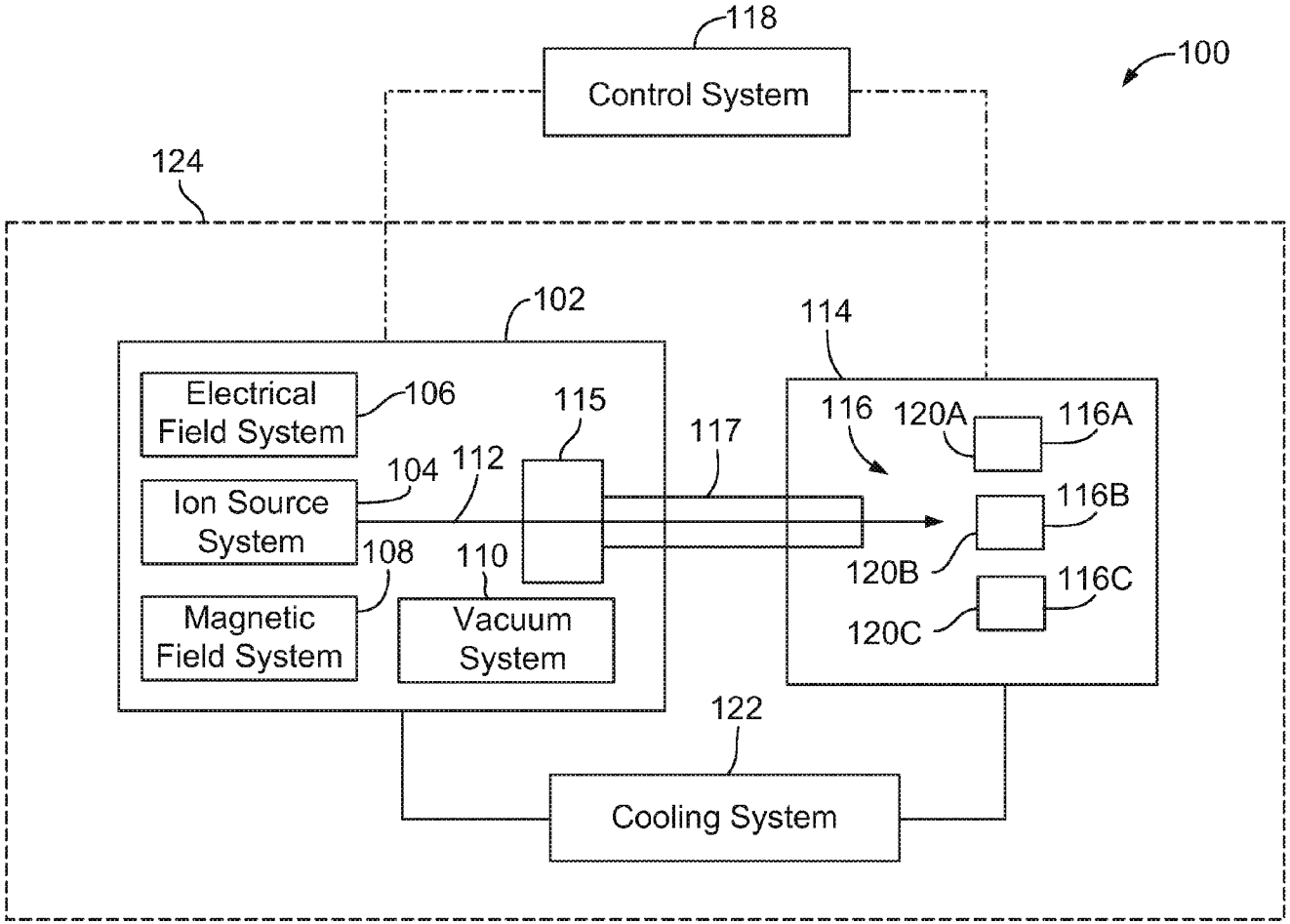
FIG. 1 is a block diagram of an isotope production system formed in accordance with one embodiment.

FIG. 1 is a block diagram of an isotope production system 100 formed in accordance with one embodiment. The system 100 includes a cyclotron 102 that has several sub-systems including an ion source system 104, an electrical field system 106, a magnetic field system 108, and a vacuum system 110. During use of the cyclotron 102, charged particles are placed within or injected into the cyclotron 102 through the ion source system 104. The magnetic field system 108 and electrical field system 106 generate respective fields that cooperate with one another in producing a particle beam 112 of the charged particles. The charged particles are accelerated and guided within the cyclotron 102 along a predetermined path. The system 100 also has an extraction system 115 and a target system 114 that includes a target material 116.

To generate isotopes, the particle beam 112 is directed by the cyclotron 102 through the extraction system 115 along a beam transport path 117 and into the target system 114 so that the particle beam 112 is incident upon the target material 116 located at a corresponding target area 120. The system 100 may have multiple target areas 120A-C where separate target materials 116A-C are located. A shifting device or system (not shown) may be used to shift the target areas 120A-C with respect to the particle beam 112 so that the particle beam 112 is incident upon a different target material 116. A vacuum may be maintained during the shifting process as well. Alternatively, the cyclotron 102 and the extraction system 115 may not direct the particle beam 112 along only one path, but may direct the particle beam 112 along a unique path for each different target area 120A-C.

Examples of isotope production systems and/or cyclotrons having one or more of the sub-systems described above are described in U.S. Pat. Nos. 6,392,246; 6,417,634; 6,433,495; and 7,122,966 and in U.S. Patent Application Publication No. 2005/0283199, all of which are incorporated by reference in their entirety. Additional examples are also provided in U.S. Pat. Nos. 5,521,469; 6,057,655; and in U.S. Patent Application Publication Nos. 2008/0067413 and 2008/0258653, all of which are incorporated by reference in their entirety.

The system 100 is configured to produce radioisotopes (also called radionuclides) that may be used in medical imaging, research, and therapy, but also for other applications that are not medically related, such as scientific research or analysis. When used for medical purposes, such as in Nuclear Medicine (NM) imaging or Positron Emission Tomography (PET) imaging, the radioisotopes may also be called tracers. By way of example, the system 100 may generate protons to make $^{18}F^-$ isotopes in liquid form, $^{11}C$ isotopes as $CO_2$, and $^{13}N$ isotopes as $NH_3$. The target material 116 used to make these isotopes may be enriched $^{18}O$ water, natural $^{14}N_2$ gas, and $^{16}O$-water. The system 100 may also generate deuterons in order to produce $^{15}O$ gases (oxygen, carbon dioxide, and carbon monoxide) and $^{15}O$ labeled water.

In some embodiments, the system 100 uses $^1H^-$ technology and brings the charged particles to a low energy (e.g., about 7.8 MeV) with a beam current of approximately 10-30 μA. In such embodiments, the negative hydrogen ions are accelerated and guided through the cyclotron 102 and into the extraction system 115. The negative hydrogen ions may then hit a stripping foil (not shown) of the extraction system 115 thereby removing the pair of electrons and making the particle a positive ion, $^1H^+$. However, in alternative embodiments, the charged particles may be positive ions, such as $^1H^+$, $^2H^+$, and $^3He^+$. In such alternative embodiments, the extraction system 115 may include an electrostatic deflector that creates an electric field that guides the particle beam toward the target material 116.

The system 100 may include a cooling system 122 that transports a cooling or working fluid to various components of the different systems in order to absorb heat generated by the respective components. The system 100 may also include a control system 118 that may be used by a technician to control the operation of the various systems and components. The control system 118 may include one or more user-interfaces that are located proximate to or remotely from the cyclotron 102 and the target system 114. Although not shown in FIG. 1, the system 100 may also include one or more radiation shields for the cyclotron 102 and the target system 114.

The system 100 may produce the isotopes in predetermined amounts or batches, such as individual doses for use in medical imaging or therapy. A production capacity for the system 100 for the exemplary isotope forms listed above may be 50 mCi in less than about ten minutes at 20 μA for $^{18}F^-$; 300 mCi in about thirty minutes at 30 μA for $^{11}CO_2$; and 100 mCi in less than about ten minutes at 20 μA for $^{13}NH_3$.

Also, the system 100 may use a reduced amount of space with respect to known isotope production systems such that the system 100 has a size, shape, and weight that would allow the system 100 to be held within a confined space. For example, the system 100 may fit within pre-existing rooms that were not originally built for particle accelerators, such as in a hospital or clinical setting. As such, the cyclotron 102, the extraction system 115, the target system 114, and one or more components of the cooling system 122 may be held within a common housing 124 that is sized and shaped to be fitted into a confined space. As one example, the total volume used by the housing 124 may be 2 $m^3$. Possible dimensions of the housing 124 may include a maximum width of 2.2 m, a maximum height of 1.7 m, and a maximum depth of 1.2 m. The combined weight of the housing and systems therein may be approximately 10000 kg. The housing 124 may be fabricated from polyethylene (PE) and lead and have a thickness configured to attenuate neutron flux and gamma rays from the cyclotron 102. For example, the housing 124 may have a thickness (measured between an inner surface that surrounds the cyclotron 102 and an outer surface of the housing 124) of at least about 100 mm along predetermined portions of the housing 124 that attenuate the neutron flux.

The system 100 may be configured to accelerate the charged particles to a predetermined energy level. For example, some embodiments described herein accelerate the charged particles to an energy of approximately 18 MeV or less. In other embodiments, the system 100 accelerates the charged particles to an energy of approximately 16.5 MeV or less. In particular embodiments, the system 100 accelerates the charged particles to an energy of approximately 9.6 MeV or less. In more particular embodiments, the system 100 accelerates the charged particles to an energy of approximately 7.8 MeV or less.

Figure 2:
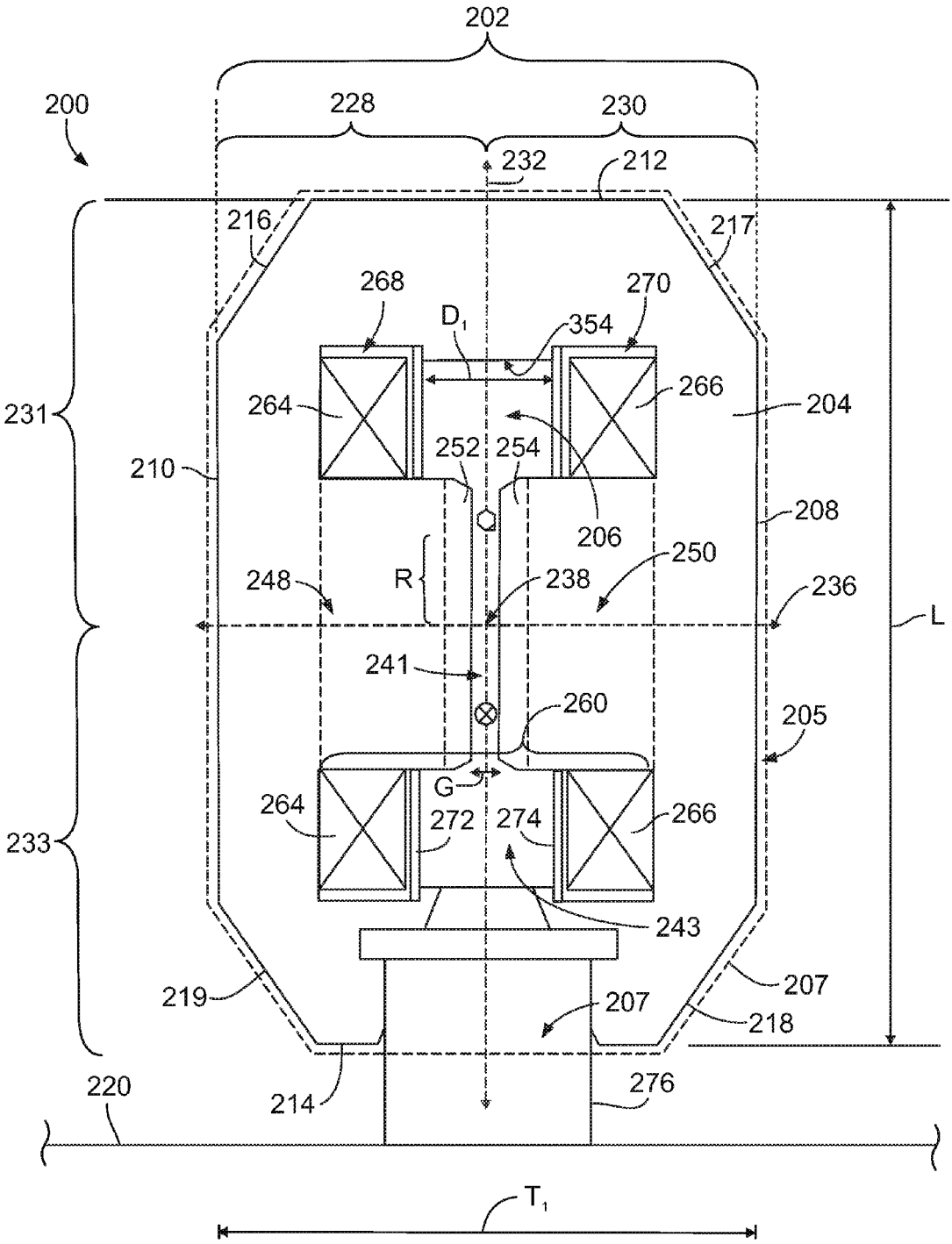
FIG. 2 is a side view of a cyclotron formed in accordance with one embodiment.

FIG. 2 is a side view of a cyclotron 200 formed in accordance with one embodiment. The cyclotron 200 includes a magnet yoke 202 having a yoke body 204 that surrounds an acceleration chamber 206. The yoke body 204 has opposed side faces 208 and 210 with a thickness $T_1$ extending therebetween and also has top and bottom ends 212 and 214 with a length L extending therebetween. The yoke body 204 may include transition regions or corners 216-219 that join the side faces 208 and 210 to the top and bottom ends 212 and 214. More specifically, the top end 212 is joined to the side faces 210 and 208 by corners 216 and 217, respectively, and the bottom end is joined to the side faces 210 and 208 by corners 219 and 218, respectively. In the exemplary embodiment, the yoke body 204 has a substantially circular cross-section and, as such, the length L may represent a diameter of the yoke body 204. The yoke body 204 may be manufactured from iron and be sized and shaped to produce a desired magnetic field when the cyclotron 200 is in operation.

As shown in FIG. 2, the yoke body 204 may be divided into opposing yoke sections 228 and 230 that define the acceleration chamber 206 therebetween. The yoke sections 228 and 230 are configured to be positioned adjacent to one another along a mid-plane 232 of the magnet yoke 202. As shown, the cyclotron 200 may be oriented vertically (with respect to gravity) such that the mid-plane 232 extends perpendicular to a horizontal platform 220. The platform 220 is configured to support the weight of the cyclotron 200 and may be, for example, a floor of a room or a slab of cement. The cyclotron 200 has a central axis 236 that extends horizontally between and through the yoke sections 228 and 230 (and corresponding side faces 210 and 208, respectively). The central axis 236 extends perpendicular to the mid-plane 232 through a center of the yoke body 204. The acceleration chamber 206 has a central region 238 located at an intersection of the mid-plane 232 and the central axis 236. In some embodiments, the central region 238 is at a geometric center of the acceleration chamber 206. Also shown, the magnet yoke 202 includes an upper portion 231 extending above the central axis 236 and a lower portion 233 extending below the central axis 236.

The yoke sections 228 and 230 include poles 248 and 250, respectively, that oppose each other across the mid-plane 232 within the acceleration chamber 206. The poles 248 and 250 may be separated from each other by a pole gap Gp. The pole 248 includes a pole top 252 and the pole 250 includes a pole top 254 that faces the pole top 252. The poles 248 and 250 and the pole gap $G_P$ are sized and shaped to produce a desired magnetic field when the cyclotron 200 is in operation. For example, in some embodiments, the pole gap $G_P$ may be 3 cm.

The cyclotron 200 also includes a magnet assembly 260 located within or proximate to the acceleration chamber 206. The magnet assembly 260 is configured to facilitate producing the magnetic field with the poles 248 and 250 to direct charged particles along a desired path. The magnet assembly 260 includes an opposing pair of magnet coils 264 and 266 that are spaced apart from each other across the mid-plane 232 at a distance $D_1$. The magnet coils 264 and 266 may be, for example, copper alloy resistive coils. Alternatively, the magnet coils 264 and 266 may be an aluminum alloy. The magnet coils may be substantially circular and extend about the central axis 236. The yoke sections 228 and 230 may form magnet coil cavities 268 and 270, respectively, that are sized and shaped to receive the corresponding magnet coils 264 and 266, respectively. Also shown in FIG. 2, the cyclotron 200 may include chamber walls 272 and 274 that separate the magnet coils 264 and 266 from the acceleration chamber 206 and facilitate holding the magnet coils 264 and 266 in position.

The acceleration chamber 206 is configured to allow charged particles, such as $^1H^-$ ions, to be accelerated therein along a predetermined curved path that wraps in a spiral manner about the central axis 236 and remains substantially along the mid-plane 232. The charged particles are initially positioned proximate to the central region 238. When the cyclotron 200 is activated, the path of the charged particles may orbit around the central axis 236. In the illustrated embodiment, the cyclotron 200 is an isochronous cyclotron and, as such, the orbit of the charged particles has portions that curve about the central axis 236 and portions that are more linear. However, embodiments described herein are not limited to isochronous cyclotrons, but also includes other types of cyclotrons and particle accelerators. As shown in FIG. 2, when the charged particles orbit around the central axis 236, the charged particles may project out of the page in the upper portion 231 of the acceleration chamber 206 and extend into the page in the lower portion 233 of the acceleration chamber 206. As the charged particles orbit around the central axis 236, a radius R that extends between the orbit of the charged particles and the central region 238 increases. When the charged particles reach a predetermined location along the orbit, the charged particles are directed into or through an extraction system (not shown) and out of the cyclotron 200.

The acceleration chamber 206 may be in an evacuated state before and during the forming of the particle beam 112. For example, before the particle beam is created, a pressure of the acceleration chamber 206 may be approximately $1\times10^{-7}$ millibars. When the particle beam is activated and $H_2$ gas is flowing through an ion source (not shown) located at the central region 238, the pressure of the acceleration chamber 206 may be approximately $2\times10^{-5}$ millibar. As such, the cyclotron 200 may include a vacuum pump 276 that may be proximate to the mid-plane 232. The vacuum pump 276 may include a portion that projects radially outward from the end 214 of the yoke body 204. As will discussed in greater detail below, the vacuum pump 276 may include a pump that is configured to evacuate the acceleration chamber 206.

Figure 8:
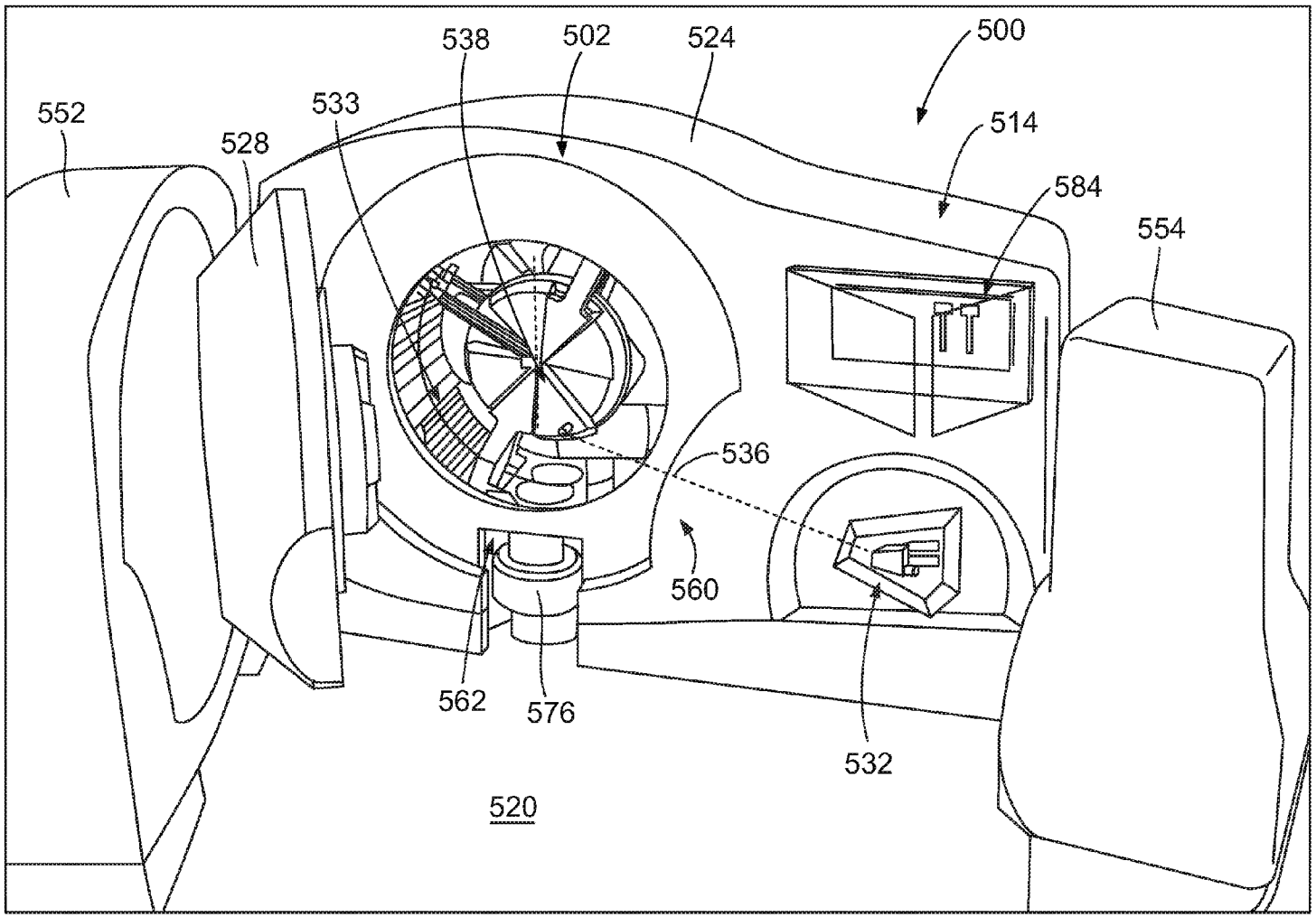
FIG. 8 is a perspective of an isotope production system formed in accordance with another embodiment.

In some embodiments, the yoke sections 228 and 230 may be moveable toward and away from each other so that the acceleration chamber 206 may be accessed (e.g., for repair or maintenance). For example, the yoke sections 228 and 230 may be joined by a hinge (not shown) that extends alongside the yoke sections 228 and 230. Either or both of the yoke sections 228 and 230 may be opened by pivoting the corresponding yoke section(s) about an axis of the hinge. As another example, the yoke sections 228 and 230 may be separated from each other by laterally moving one of the yoke sections linearly away from the other. However, in alternative embodiments, the yoke sections 228 and 230 may be integrally formed or remain sealed together when the acceleration chamber 206 is accessed (e.g., through a hole or opening of the magnet yoke 202 that leads into the acceleration chamber 206). In alternative embodiments, the yoke body 204 may have sections that are not evenly divided and/or may include more than two sections. For example, the yoke body may have three sections as shown in FIG. 8 with respect to the magnet yoke 504.

The acceleration chamber 206 may have a shape that extends along and is substantially symmetrical about the mid-plane 232. For instance, the acceleration chamber 206 may be substantially disc-shaped and include an inner spatial region 241 defined between the pole tops 252 and 254 and an outer spatial region 243 defined between the chamber walls 272 and 274. The orbit of the particles may be during operation of the cyclotron 200 may be within the spatial region 241. The acceleration chamber 206 may also include passages that lead radially outward away from the spatial region 243, such as a passage $P_1$ (shown in FIG. 3) that leads toward the vacuum pump 276.

Also shown in FIG. 2, the yoke body 204 has an exterior surface 205 that defines an envelope 207 of the yoke body 204. The envelope 207 has a shape that is about equivalent to a general shape of the yoke body 204 defined by the exterior surface 205 without small cavities, cut-outs, or recesses. (For illustrative purposes, the envelope 207 is shown in FIG. 2 as being larger than the yoke body 204.) For example, a portion of the envelope 207 is indicated by a dashed-line that extends along a plane defined by the exterior surface 205 of the end 214. As shown in FIG. 2, a cross-section of the envelope 207 is an eight-sided polygon defined by the exterior surface 205 of the side faces 208 and 210, ends 212 and 214, and corners 216-219. As will be discussed in further detail below, the yoke body 204 may form passages, cut-outs, recesses, cavities, and the like that allow component or devices to penetrate into the envelope 207.

Furthermore, the poles 248 and 250 (or, more specifically, the pole tops 252 and 254) may be separated by the spatial region 241 therebetween where the charged particles are directed along the desired path. The magnet coils 264 and 266 may also be separated by the spatial region 243. In particular, the chamber walls 272 and 274 may have the spatial region 243 therebetween. Furthermore, a periphery of the spatial region 243 may be defined by a wall surface 354 that also defines a periphery of the acceleration chamber 206. The wall surface 354 may extend circumferentially about the central axis 236. As shown, the spatial region 241 extends a distance equal to a pole gap $G_P$ (FIG. 3) along the central axis 236, and the spatial region 243 extends the distance $D_1$ along the central axis 236.

As shown in FIG. 2, the spatial region 243 surrounds the spatial region 241 about the central axis 236. The spatial regions 241 and 243 may collectively form the acceleration chamber 206. Accordingly, in the illustrated embodiment, the cyclotron 200 does not include a separate tank or wall that only surrounds the spatial region 241 thereby defining the spatial region 243 as the acceleration chamber of the cyclotron. More specifically, the vacuum pump 276 is fluidicly coupled to the spatial region 241 through the spatial region 243. Gas entering the spatial region 241 may be evacuated from the spatial region 241 through the spatial region 243. The vacuum pump 276 is fluidicly coupled to the spatial region 243.

Figure 3:
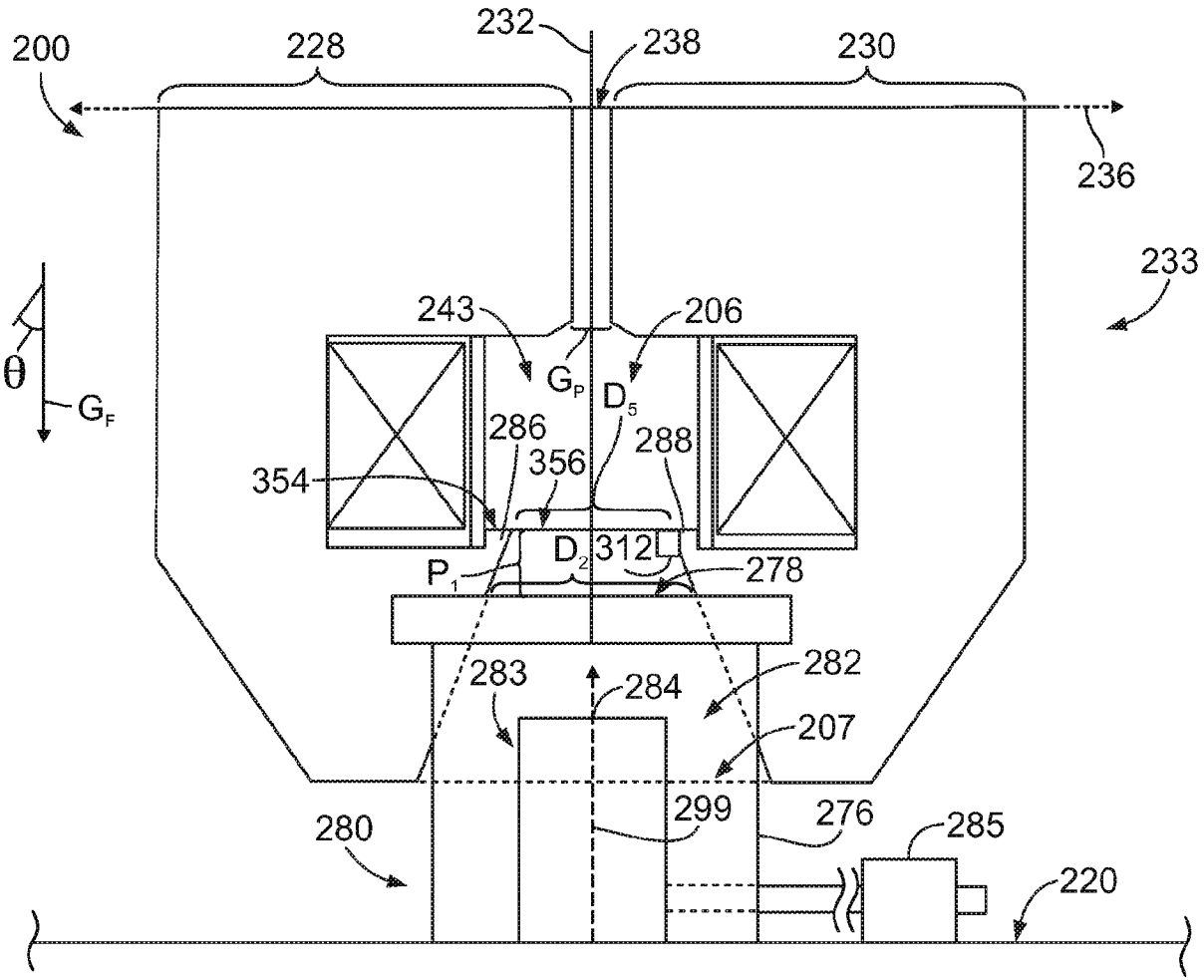
FIG. 3 is a side view of a bottom portion of the cyclotron shown in FIG. 2.

FIG. 3 is an enlarged side cross-section of the cyclotron 200 and, more specifically, the lower portion 233. The yoke body 204 may define a port 278 that opens directly onto the acceleration chamber 206. The vacuum pump 276 may be directly coupled to the yoke body 204 at the port 278. The port 278 provides an entrance or opening into the vacuum pump 276 for undesirable gas particles to flow therethrough. The port 278 may be shaped (along with other factors and dimensions of the cyclotron 200) to provide a desired conductance of the gas particles through the port 278. For example, the port 278 may have a circular, square-like, or another geometric shape.

The vacuum pump 276 is positioned within a pump acceptance (PA) cavity 282 formed by the yoke body 204. The PA cavity 282 is fluidicly coupled to the acceleration chamber 206 and opens onto the spatial region 243 of the acceleration chamber 206 and may include a passage $P_1$. When positioned within the PA cavity 282, at least a portion of the vacuum pump 276 is within the envelope 207 of the yoke body 204 (FIG. 2). The vacuum pump 276 may project radially outward away from the central region 238 or central axis 236 along the mid-plane 232. The vacuum pump 276 may or may not project beyond the envelope 207 of the yoke body 204. By way of example, the vacuum pump 276 may be located between the acceleration chamber 206 and the platform 220 (i.e., the vacuum pump 276 is located directly below the acceleration chamber 206). In other embodiments, the vacuum pump 276 may also project radially outward away from the central region 238 along the mid-plane 232 at another location. For example, the vacuum pump 276 may be above or behind the acceleration chamber 206 in FIG. 2. In alternative embodiments, the vacuum pump 276 may project away from one of the side faces 208 or 210 in a direction that is parallel to the central axis 236. Also, although only one vacuum pump 276 is shown in FIG. 3, alternative embodiments may include multiple vacuum pumps. Furthermore, the yoke body 204 may have additional PA cavities.

More specifically, the vacuum pump 276 may be directly coupled to the yoke body 204 at the port 278 and positioned between the yoke body 204 and the platform 220 and oriented with respect to a gravitational force direction $G_F$. The vacuum pump 276 may be oriented such that a longitudinal axis 299 of the vacuum pump 276 extends with the gravitational force direction $G_F$ (i.e., $G_F$ and the longitudinal axis 299 extend parallel to each other). In alternative embodiments, the longitudinal axis 299 of the vacuum pump 276 may form an angle θ with respect to the gravitational force direction $G_F$. The angle θ may be, for example, greater than 10 degrees. In other embodiments, the angle θ is about 90 degrees. In other embodiments, the angle θ is greater than 90 degrees. As shown, the angle θ may rotate along a plane formed by an axis that extends along the gravitational force direction and the central axis 236 (i.e., the angle θ rotates about an axis that extends into and out of the page). However, the angle θ may also rotate along the mid-plane 232. As such, the vacuum pump 276 may be oriented such that the longitudinal axis 299 extends radially toward the center portion 238 along the mid-plane 232.

In particular embodiments, the vacuum pump 276 is a turbomolecular or fluidless vacuum pump. Known vacuum systems that use oil diffusion pumps may not be oriented at an angle θ as described above because oil may spill into the acceleration chamber. However, some of the pumps described herein, such as a turbomolecular pump, may be directly coupled to the yoke body 204 and oriented at an angle θ that is greater than 10 degrees, because such pumps do not require a fluid that may spill in the acceleration chamber 206. Furthermore, such pumps may be oriented at an angle θ that is 90 degrees or at least partially upside-down.

The vacuum pump 276 includes a tank wall 280 and a vacuum or pump assembly 283 held therein. The tank wall 280 is sized and shaped to fit within the PA cavity 282 and hold the pump assembly 283 therein. For example, the tank wall 280 may have a substantially circular cross-section as the tank wall 280 extends from the cyclotron 200 to the platform 220. Alternatively, the tank wall 280 may have other cross-sectional shapes. The tank wall 280 may provide enough space therein for the pump assembly 283 to operate effectively. The wall surface 354 may define an opening 356 and the yoke sections 228 and 230 may form corresponding rim portions 286 and 288 that are proximate to the port 278. The rim portions 286 and 288 may define the passage $P_1$ that extends from the opening 356 to the port 278. The port 278 opens onto the passage $P_1$ and the acceleration chamber 206 and has a diameter $D_2$. The opening 356 has a diameter $D_5$. The diameters $D_2$ and $D_5$ may be configured so that the cyclotron 200 operates at a desired efficiency in producing the radioisotopes. For example, the diameters $D_2$ and $D_5$ may be based upon a size and shape of the acceleration chamber 206, including the pole gap $G_P$, and an operating conductance of the pump assembly 283. As a specific example, the diameter $D_2$ may be about 250 mm to about 300 mm.

The pump assembly 283 may include one or more pumping devices 284 that effectively evacuates the acceleration chamber 206 so that the cyclotron 200 has a desired operating efficiency in producing the radioisotopes. The pump assembly 283 may include a one or more momentum-transfer type pumps, positive displacement type pumps, and/or other types of pumps. For example, the pump assembly 283 may include a diffusion pump, an ion pump, a cryogenic pump, a rotary vane or roughing pump, and/or a turbomolecular pump. The pump assembly 283 may also include a plurality of one type of pump or a combination of pumps using different types. The pump assembly 283 may also have a hybrid pump that uses different features or sub-systems of the aforementioned pumps. As shown in FIG. 3, the pump assembly 283 may also be fluidicly coupled in series to a rotary vane or roughing pump 285 that may release the air into the surrounding atmosphere.

Furthermore, the pump assembly 283 may include other components for removing the gas particles, such as additional pumps, tanks or chambers, conduits, liners, valves including ventilation valves, gauges, seals, oil, and exhaust pipes. In addition, the pump assembly 283 may include or be connected to a cooling system. Also, the entire pump assembly 283 may fit within the PA cavity 282 (i.e., within the envelope 207) or, alternatively, only one or more of the components may be located within the PA cavity 282. In the exemplary embodiment, the pump assembly 283 includes at least one momentum-transfer type vacuum pump (e.g., diffusion pump, or turbomolecular pump) that is located at least partially within the PA cavity 282.

Also shown, the vacuum pump 276 may be communicatively coupled to a pressure sensor 312 within the acceleration chamber 206. When the acceleration chamber 206 reaches a predetermined pressure, the pumping device 284 may be automatically activated or automatically shut-off. Although not shown, there may be additional sensors within the acceleration chamber 206 or PA cavity 282.

Figure 4:
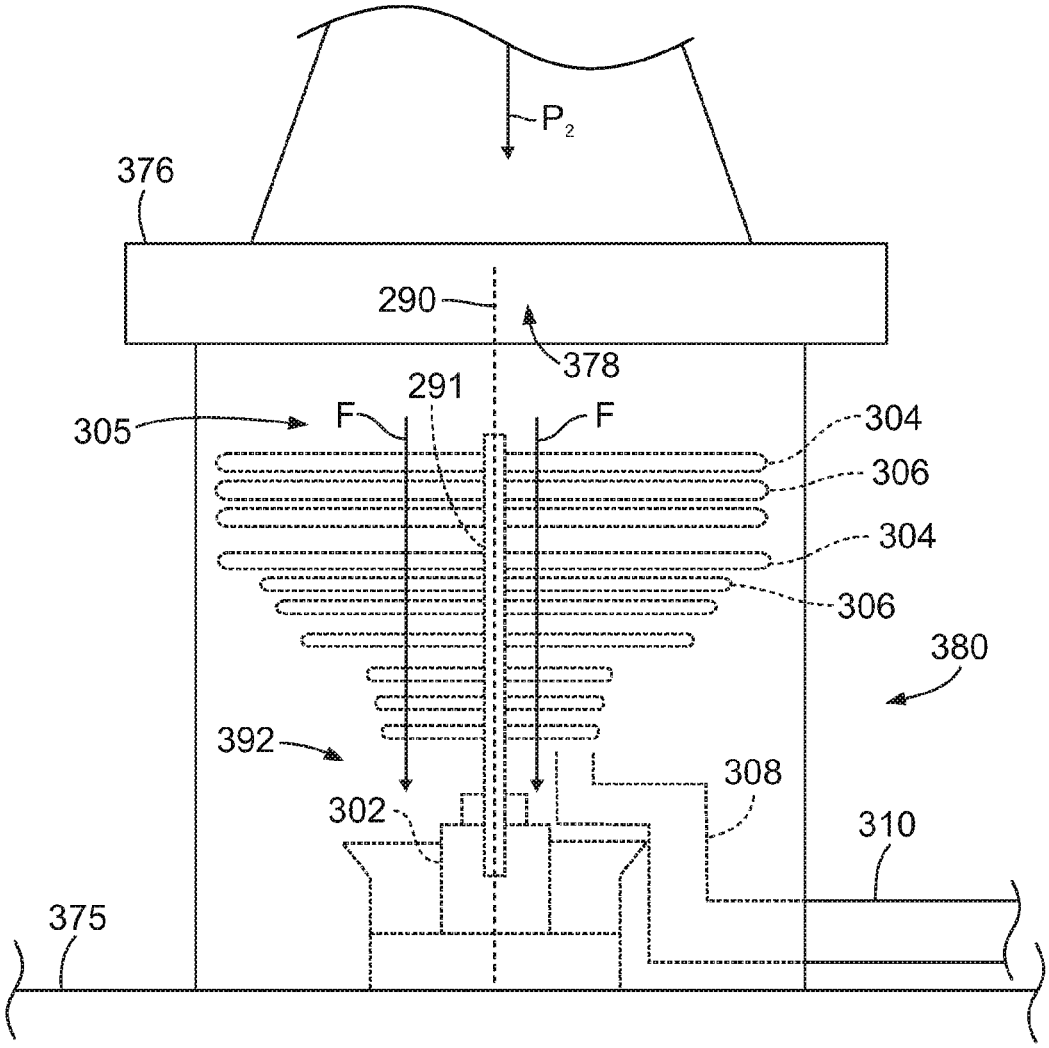
FIG. 4 is a side view of a vacuum pump and turbomolecular pump that may be used with the cyclotron shown in FIG. 2.

FIG. 4 illustrates a side view of a turbomolecular pump 376 formed in accordance with an embodiment that may be used as the vacuum pump 276 (FIG. 2). The turbomolecular pump 376 may be directly coupled to the yoke body 204 (i.e., not coupled to the yoke body through a conduit or duct that extends away from the yoke body 204 out of the PA cavity.) The turbomolecular pump 376 may extend along a central axis 290 between a port 378 of a magnet yoke and a platform 375. The turbomolecular pump 376 includes a motor 302 that is operatively coupled to a rotating fan 305. The rotating fan 305 may include one or more stages of rotor blades 304 and stator blades 306. Each rotor blade 304 and stator blade 306 projects radially outward from an axle 291 that extends along the central axis 290. In use, the turbomolecular pump 376 operates similarly as a compressor. The rotor blades 304, stator blades 306, and axle 291 rotate about the central axis 290. Gas particles flowing along a passage $P_2$ enter the turbomolecular pump 376 through the port 378 and are initially hit by a set of rotor blades 304. The rotor blades 304 are shaped to push the gas particles away from an acceleration chamber of the cyclotron, such as the acceleration chamber 206 (FIG. 3). The stator blades 306 are positioned adjacent to corresponding rotor blades 304 and also push the gas particles away from the acceleration chamber. This process continues through the remaining stages of rotor and stator blades 304 and 306 of the fan 305 so that the flow of air moves in a direction away from the acceleration chamber toward a bottom region 392 of the turbomolecular pump 376 (arrows F indicate the direction of flow). When the gas particles reach the bottom region 392 of the turbomolecular pump 376, the gas particles may be forced out of the turbomolecular pump 376 through an exhaust or conduit 308. The exhaust 308 directs the air removed from the acceleration chamber through an outlet 310 that projects from a tank wall 380. The outlet 210 may be fluidicly coupled to a rotary vane or roughing pump (not shown).

Figure 5:
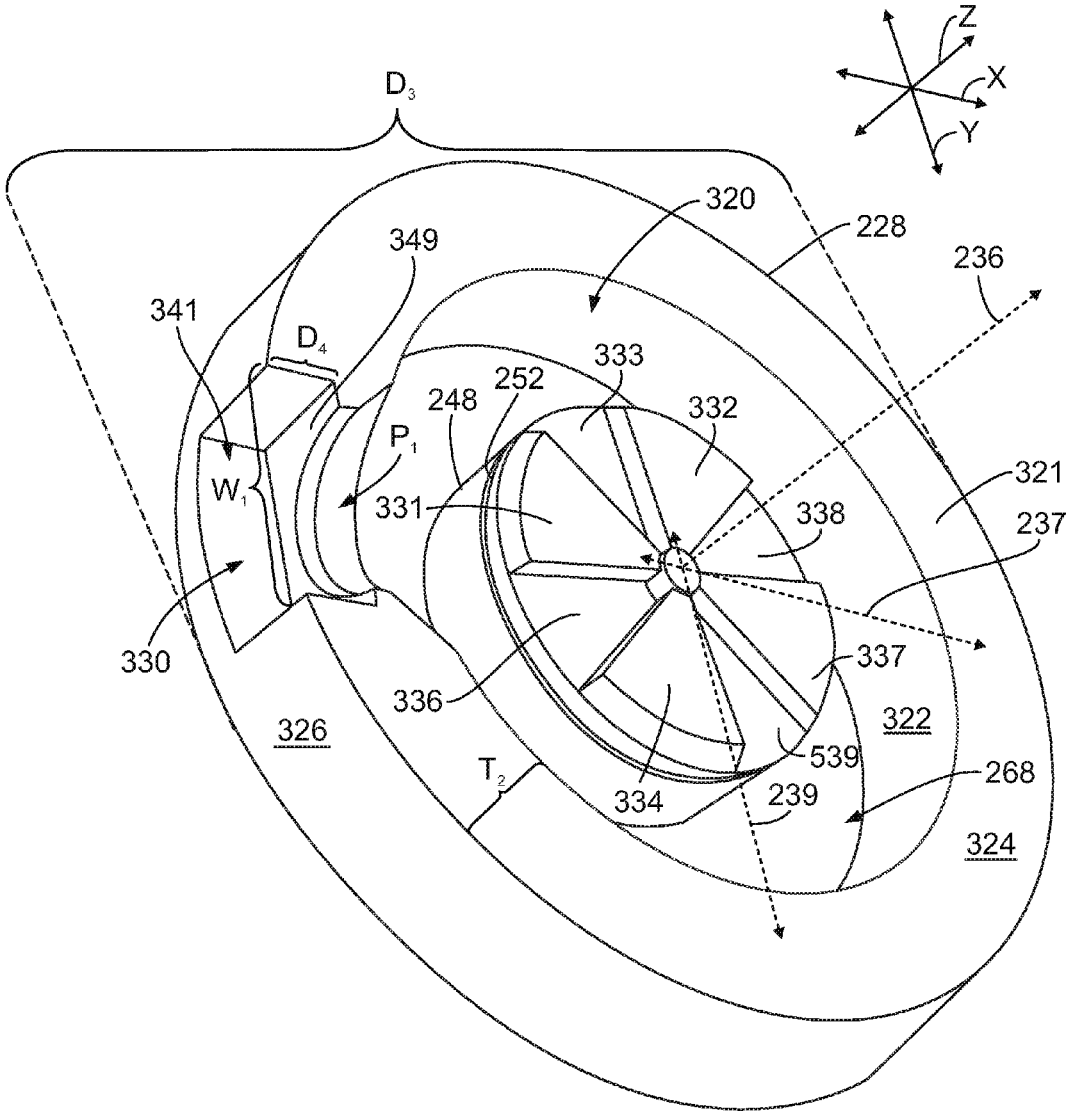
FIG. 5 is a perspective view of a portion of a yoke body that may be used with the cyclotron shown in FIG. 2.

FIG. 5 is an isolated perspective view of the yoke section 228 and illustrates in greater detail the pole 248, the coil cavity 268, and the passage $P_1$ that leads to the port 278 (FIG. 2) of the vacuum pump 276 (FIG. 2). X-, Y-, and Z-axes indicate an orientation of the yoke section 228 in FIG. 5. The mid-plane 232 is formed by the X-axis and Y-axis. The central axis 236 extends along a Z-axis. The yoke section 228 has a substantially circular body including a diameter $D_3$ that is equal to the length L shown in FIG. 2. The yoke section 228 includes an open-sided cavity 320 defined within a ring portion 321. The ring portion 321 has an inner surface 322 that extends around the central axis 236 and defines a periphery of the open-sided cavity 320. The yoke section 228 also has an exterior surface 326 that extends around the ring portion 321. A radial thickness $T_2$ of the ring portion 321 is defined between the inner and exterior surfaces 322 and 326.

As shown, the pole 248 is located within the open-sided cavity 320. The ring portion 321 and the pole 248 are concentric with each other and have the central axis 236 extending therethrough. The pole 248 and the inner surface 322 define at least a portion of the coil cavity 268 therebetween. In some embodiments, the yoke section 228 includes a mating surface 324 that extends along the ring portion 321 and parallel to the plane defined by the radial lines 237 and 239. The mating surface 324 is configured to mate with an opposing mating surface (not shown) of the yoke section 230 when the yoke sections 228 and 230 are mated together along the mid-plane 232 (FIG. 2).

Also shown, the yoke section 228 may include a yoke recess 330 that partially defines the passage $P_1$ and the PA cavity 282 (FIG. 3). The yoke section 230 may have a similarly shaped yoke recess 340 (shown in FIG. 6) such that the yoke body 204 (FIG. 2) forms the passage $P_1$ and the PA cavity 282. The yoke recess 330 is shaped to receive the vacuum pump 276 when the yoke body 204 is fully formed. For example, the yoke recess 330 may have a cut-out 341 that may be rectangular shaped and extend a depth $D_4$ into the yoke section 228 toward the central axis 236. The cut-out 341 may also have a width $W_1$ that extends along an arc portion of the yoke section 228. The yoke section 228 may also form a ledge portion 349 that partially defines the port 278 (FIG. 3) or the passage $P_1$. The recess 330, including the ledge portion 349 and the cut-out 341, may be sized and shaped to have minimal or no effect on the magnet fields during operation of the cyclotron 200 (FIG. 2).

In one embodiment, all or a portion of the surface 322 and any other surface that may interact with the particles is plated with copper. The copper-plated surfaces are configured to reduce the influence of a porous iron surface. In one embodiment, interior surfaces of the vacuum pump 276 may include copper plating. The copper-plated interior surfaces may also be configured to reduce the surface resistively.

Although not shown, there may be additional holes, openings, or passages extending through the radial thickness $T_2$ of the yoke section 228. For example, there may be an RF feed-through and other electrical connections that extend through the radial thickness $T_2$. There may also be a beam exit channel where the particle beam exits the cyclotron 200 (FIG. 2). Furthermore, a cooling system (not shown) may have conduits extending through the radial thickness $T_2$ for cooling components within the acceleration chamber 206.

In the illustrated embodiment, the cyclotron 200 is an isochronous cyclotron where the pole top 252 of the magnet pole 248 forms an arrangement of sectors including hills 331-334 and valleys 336-339. As will be discussed in greater detail below, the hills 331-334 and the valleys 336-339 interact with corresponding hills and valleys of the pole 250 (FIG. 2) to produce a magnetic field for focusing the path of the charged particles.

Figure 6:
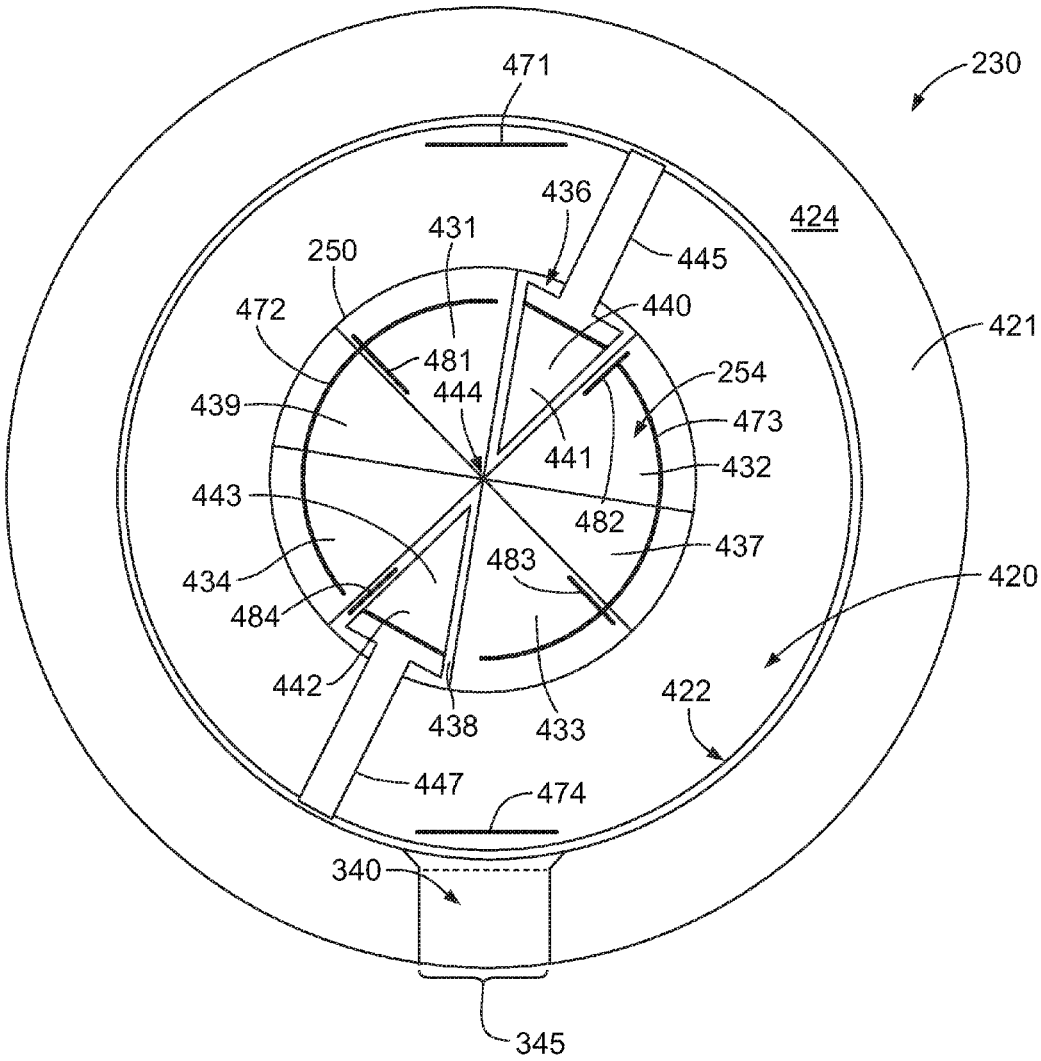
FIG. 6 is a plan view of a magnet and yoke assembly that may be used with the cyclotron shown in FIG. 2.

FIG. 6 is a plan view of the yoke section 230. The yoke section 230 may have similar components and features as described with respect to the yoke section 228 (FIG. 2). For example, the yoke section 230 includes a ring portion 421 that defines an open-sided cavity 420 having the magnet pole 250 located therein. The ring portion 421 may include a mating surface 424 that is configured to engage the mating surface 324 (FIG. 5) of the yoke section 228. Also shown, the yoke section 230 includes the yoke recess 340. When the yoke body 204 (FIG. 2) is fully formed, the cut-out 341 (FIG. 5) and the cut-out 345 are combined to form the PA cavity 282, the vacuum port 278, and the passage $P_1$. The PA cavity 282 may be substantially cube- or box-shaped so that the vacuum pump 276 may fit therein and the vacuum port 278 may be circular. However, in alternative embodiments, the PA cavity 282 and the port 278 may have other shapes.

The pole top 254 of the pole 250 includes hills 431-434 and valleys 436-439. The yoke section 230 also includes radio frequency (RF) electrodes 440 and 442 that extend radially inward toward each other and toward a center 444 of the pole 250. The RF electrodes 440 and 442 include hollow dees 441 and 443, respectively, that extend from stems 445 and 447, respectively. The dees 441 and 443 are located within the valleys 436 and 438, respectively. The stems 445 and 447 may be coupled to an inner surface 422 of the ring portion 421. Also shown, the yoke section 230 may include a plurality of interception panels 471-474 arranged about the pole 250 and inner surface 422. The interception panels 471-474 are positioned to intercept lost particles within the acceleration chamber 206. The interception panels 471-474 may comprise aluminum. The yoke section 230 may also include beam scrapers 481-484 that may also comprise aluminum.

The RF electrodes 440 and 442 may form an RF electrode system, such as the electrical field system 106 described with reference to FIG. 1, in which the RF electrodes 440 and 442 accelerate the charged particles within the acceleration chamber 206 (FIG. 2). The RF electrodes 440 and 442 cooperate with each other and form a resonant system that includes inductive and capacitive elements tuned to a predetermined frequency (e.g., 100 MHz). The RF electrode system may have a high frequency power generator (not shown) that may include a frequency oscillator in communication with one or more amplifiers. The RF electrode system creates an alternating electrical potential between the RF electrodes 440 and 442 thereby accelerating the charged particles.

Figure 7A:
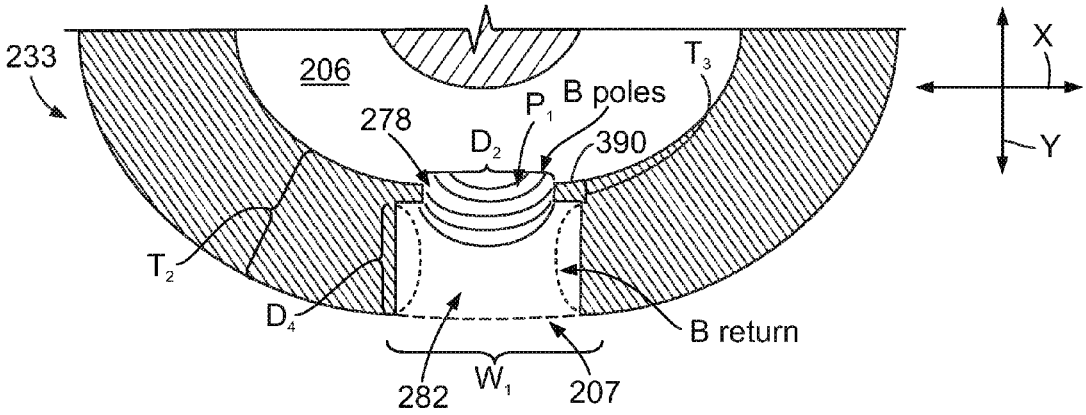
FIG. 7A is a front cross-sectional view of the bottom portion of the cyclotron indicating the magnetic field experienced therein.
Figure 7B:
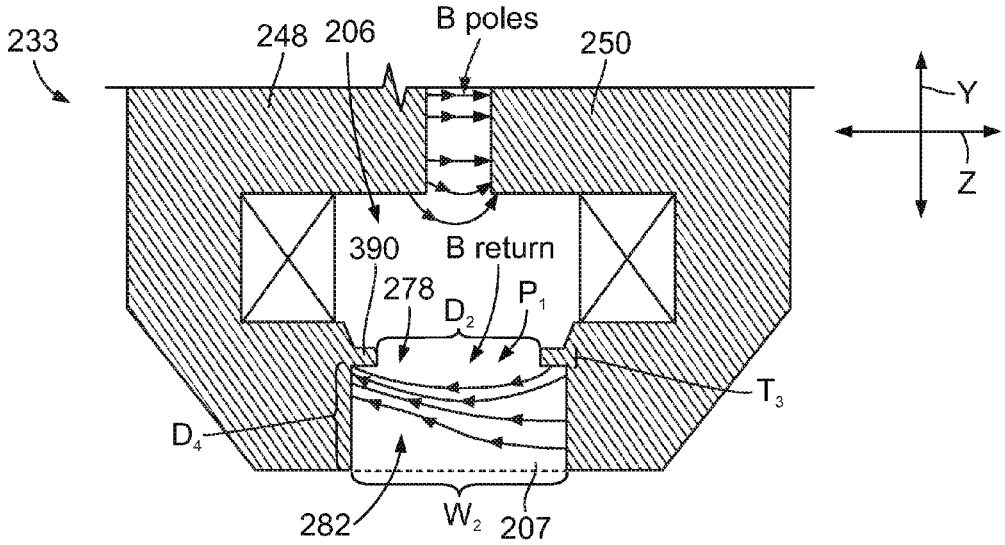
FIG. 7B is a front cross-sectional view of the bottom portion of the cyclotron indicating the magnetic field experienced therein.

FIGS. 7A and 7B are cross-sectional views of the bottom portion 233 of the cyclotron 200 (FIG. 2) indicating the magnetic field experienced by the bottom portion 233. FIG. 7A is taken along the mid-plane 232 (FIG. 2) formed by the X-axis and Y-axis, and FIG. 7B is taken along a plane formed by the Y-axis and Z-axis. For illustrative purposes, the vacuum pump 276 (FIG. 2) has not been shown. However, the vacuum pump 276 may be any of the vacuum pumps discussed above, including a turbomolecular pump, a non-diffusion pump, or a fluidless pump having a rotating fan. During operation of the cyclotron 200, magnetic fields generated by the cyclotron 200 may escape from a desired region and into a region where magnetic fields are not desired. Such magnetic fields are generally referred to as "stray fields." FIGS. 7A and 7B illustrate stray fields that affect the PA cavity 282. The stray fields are indicated by magnetic field lines B. The magnetic field within the PA cavity 282 may include two components. Namely, a magnetic field (indicated by field lines $B_{POLES}$) generated between the poles 248 and 250 (or pole tops 252 and 254) that penetrate into the PA cavity 282 through the vacuum port 278 and an oppositely directed magnetic field (indicated by field lines $B_{RETURN}$) that returns through the PA cavity 282. As the magnetic field lines $B_{POLES}$ and $B_{RETURN}$ extend further away from the vacuum port 278, the corresponding magnitudes of the field lines reduce. Furthermore, the $B_{POLES}$ and $B_{RETURN}$ have oppositely directed magnetic fields, which may further reduce a magnitude of the magnetic fields experienced within the PA cavity 282.

As shown in FIGS. 7A and 7B, the cyclotron 200 may be configured to generate an average magnetic field between the poles 248 and 250 such that magnetic stray fields occur within the PA cavity 282. In such embodiments, the vacuum pump 276 may still be positioned at least partially within the PA cavity 282 and/or at least partially within the envelope 207 of the yoke body 204. For example, the magnetic stray fields occurring within the PA cavity 282 may be reduced or limited such that the vacuum pump 276 may effectively operate within the PA cavity 282. As used herein, "to effectively operate" while positioned within the PA cavity 282 and/or within the envelope 207 includes the vacuum pump 276 operating for a commercially reasonable period of time. For example, the vacuum pump 276 may operate for years without sustaining significant damage or requiring that the vacuum pump 276 be replaced.

Dimensions of the yoke body 204 and the PA cavity 282 may be configured such that the magnetic field experienced within the PA cavity 282 does not exceed a predetermined value. More specifically, one or more of the depth $D_4$, the thickness $T_2$ of the yoke body 204, the width $W_1$ (FIG. 7A), a width $W_2$ (FIG. 7B), and the diameter $D_2$ of the vacuum port 278 may be sized and shaped so that the magnetic field within the PA cavity 282 does not exceed a predetermined value. For example, the depth $D_4$ may be greater than one-half (½) of the thickness $T_2$. Furthermore, the yoke body 204 may define a rim 390 having a thickness $T_3$ that may be, for example, a difference between the thickness $T_2$ and the depth $D_4$. The diameter $D_2$ and the thickness $T_3$ may be sized and shaped that not only allows a predetermined level of conductance, but also reduces the magnetic field experienced within the PA cavity 282 to a predetermined value. In one embodiment, the thickness $T_2$ is approximately 200 mm, the depth $D_4$ may be greater than 150 mm, and the diameter $D_2$ is approximately 300 mm. However, the aforementioned dimensions of the yoke body 204 are only illustrative and not intended to be limiting. The dimensions of the yoke body 204 may be other values in alternative embodiments.

As such, the cyclotron 200 may be configured so that a magnitude of the magnetic field experienced by the vacuum pump 276 does not exceed a predetermined value. For example, the average magnetic field between the poles 248 and 250 may be at least 1 Tesla and the magnetic fields experienced by the vacuum pump 276 may be less than about 75 Gauss. More particularly, the average magnetic field between the poles 248 and 250 may be at least 1 Tesla and the magnetic fields experienced by the vacuum pump 276 may be less than about 50 Gauss. In other embodiments, the average magnetic field between the poles 248 and 250 may be at least 1.5 Tesla and the magnetic fields experienced by the vacuum pump 276 may be less than about 75 Gauss or may be less than about 50 Gauss. More particularly, the magnetic fields experienced by the vacuum pump 276 may be less than about 30 Gauss when the average magnetic field between the poles 248 and 250 is 1 Tesla or 1.5 Tesla.

The vacuum pump 276 (e.g., a turbomolecular pump) may be coupled directly to the vacuum port 278. However, the vacuum pump 276 may be positioned a distance into the PA cavity 282 (i.e., away from the acceleration chamber 206) so that the vacuum pump 276 is a greater distance away from the vacuum port 278. In some embodiments, the magnetic field experienced at the vacuum port 278 may exceed the predetermined value in which the vacuum pump 276 may effectively operate. However, in such embodiments, the operative components of the vacuum pump 276, such as a motor or a rotating fan, may be located within the vacuum pump 276 such that the magnetic field experienced by these operative components does not prevent the vacuum pump 276 from operating effectively.

Furthermore, in alternative embodiments, the PA cavity 282 may have a shield positioned therein that surrounds the vacuum pump 276. The shield may be used to attenuate the magnetic fields experienced by the vacuum pump 276.

Figure 10B:
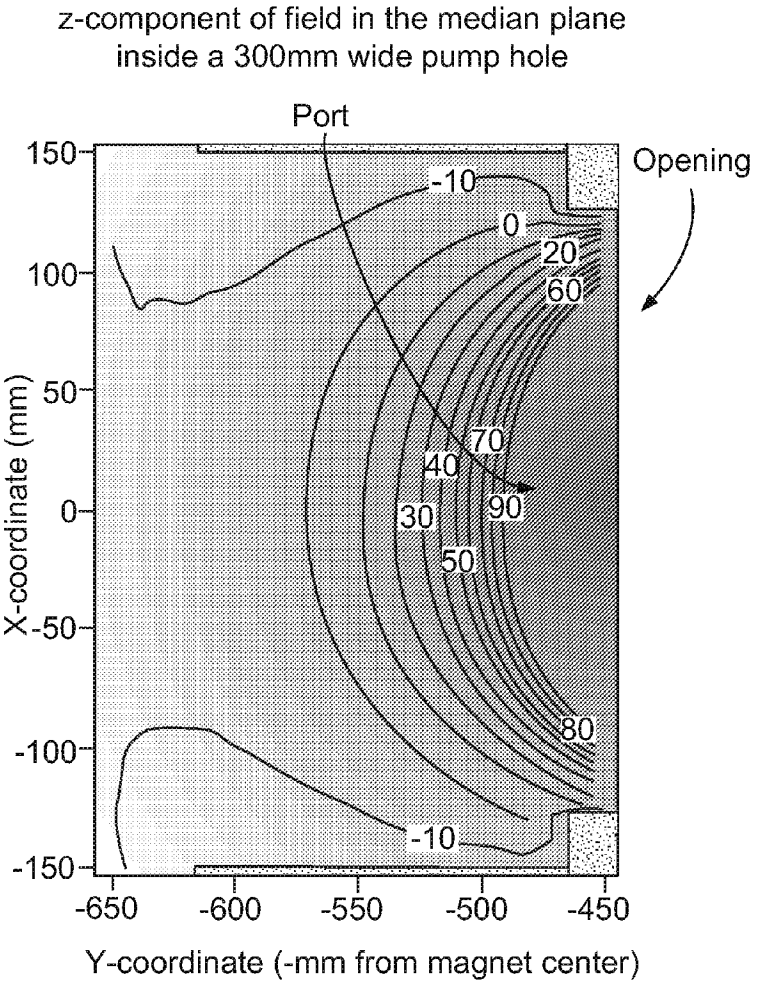
FIGS. 10A-10E are graphs illustrating magnetic fields experienced within a pump acceptance (PA) cavity along planes that extend through the PA cavity.
Figure 10A:
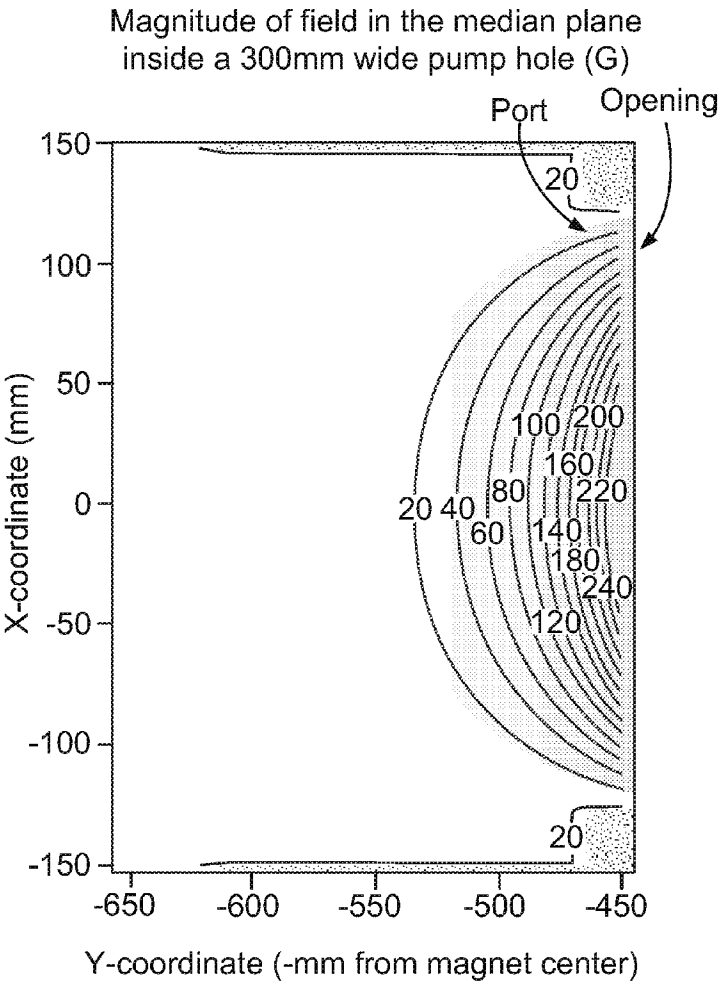
Figure 10D:
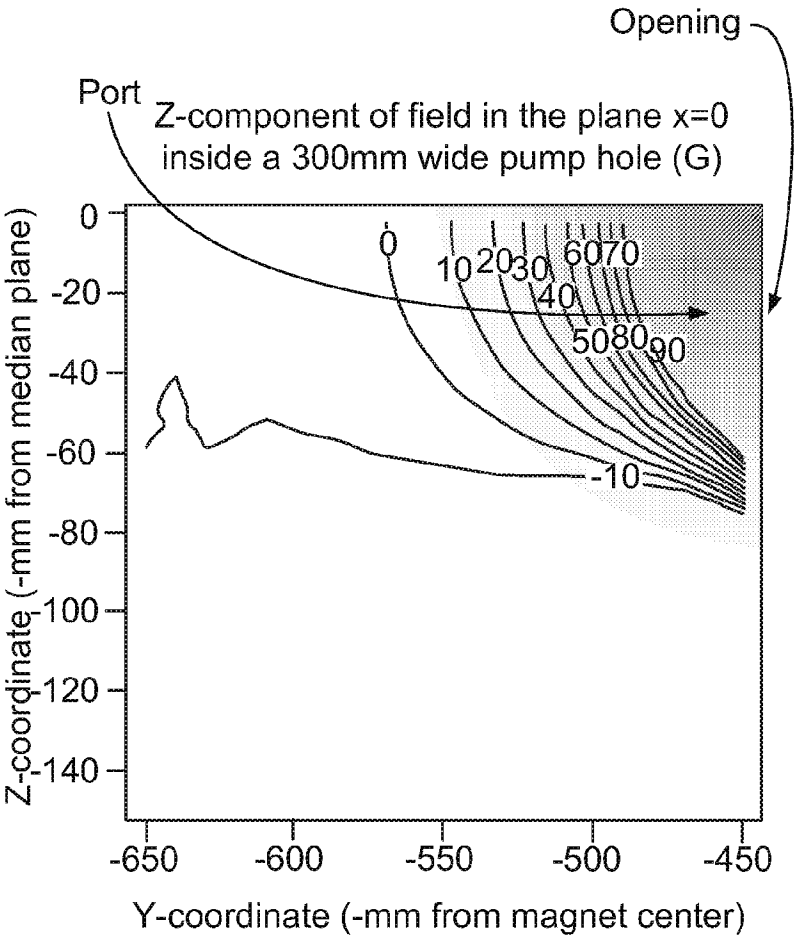
Figure 10C:
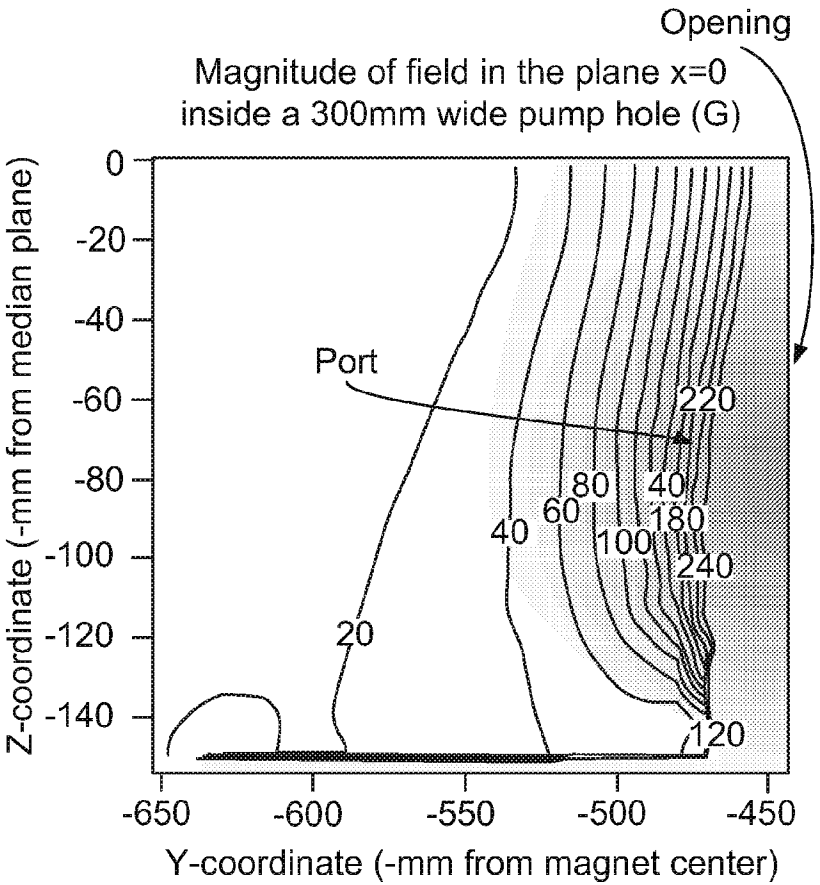
Figure 10E:
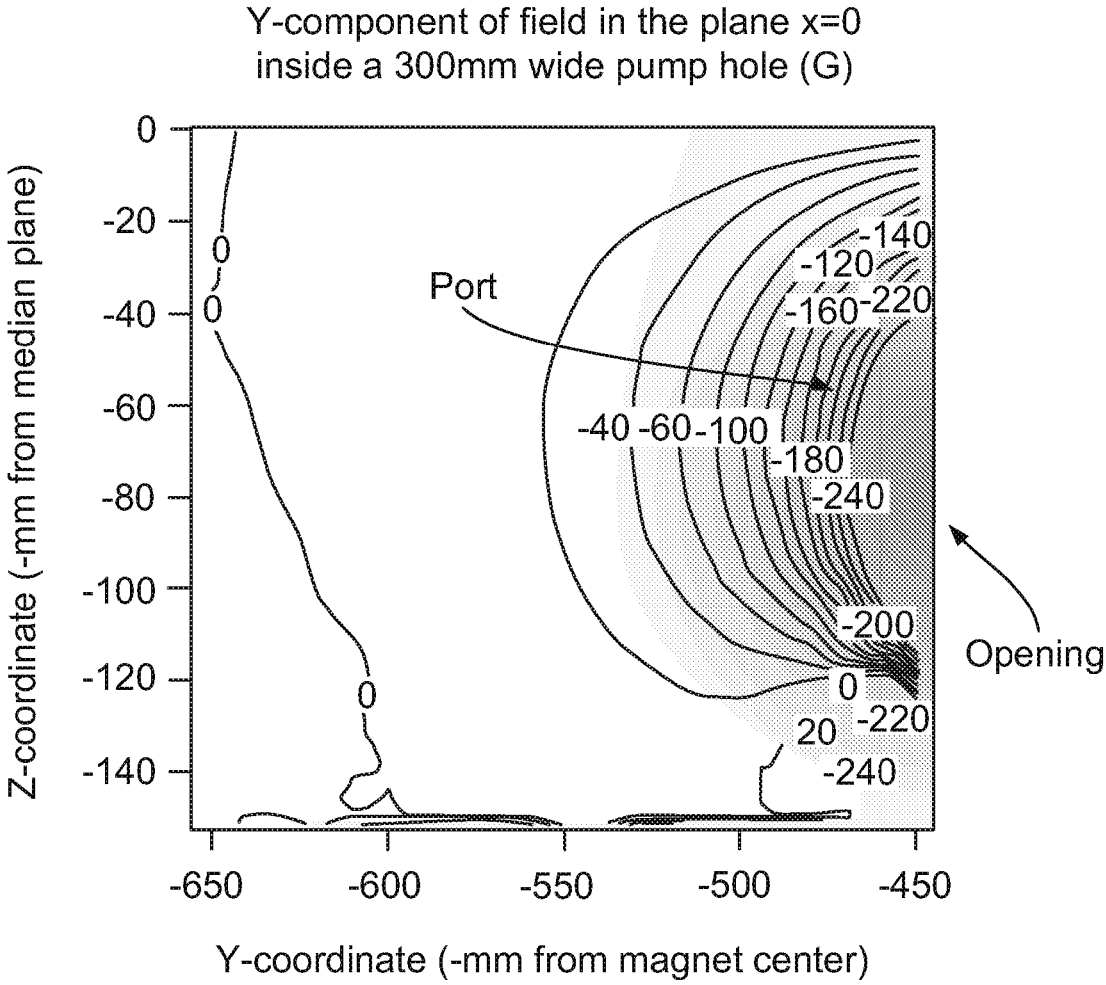

FIGS. 10A-10E are graphs illustrating magnetic fields experienced within a PA cavity along planes that extend through the PA cavity. In particular, FIGS. 10A-10E illustrate the magnetic field experienced by the PA cavity a distance away from a geometric center of the yoke body (i.e., along the X-axis as shown in FIG. 5) and along a width or diameter of the PA cavity (i.e., along the Y- or Z-axes as shown in FIG. 5). The PA cavity for FIGS. 10A-10E has a passage similar to the passage $P_1$ (FIG. 3) that extends from an opening proximate to an acceleration chamber to a port. In the FIGS. 10A-10E, the opening has a diameter of 250 mm and the port has a diameter of 300 mm. FIG. 10A illustrates a magnitude of the magnetic field along a median plane, such as the median plane 232 (FIG. 2) or XY plane (FIG. 5); FIG. 10B illustrates a z-component of the magnetic field in the XY plane; FIG. 10C illustrates a magnitude of the magnetic field along the YZ plane; FIG. 10D illustrates a z-component of the magnetic field in the YZ plane; and FIG. 10E illustrates a y-component of the magnetic field in the YZ plane.

As shown in FIGS. 10A-10E, the magnetic field inside the PA cavity has two components, namely, a component from the magnetic field between poles that penetrates through and into the PA cavity and a component of the oppositely directed yoke field, which takes a path through the PA cavity instead of the material (e.g., iron) of the yoke body. FIGS. 10A-10E show the magnitude of the magnetic field and the dominating field components in two perpendicular planes through the port (median plane, z=0, and the symmetry plane x=0).

FIG. 8 is a perspective view of an isotope production system formed in accordance with one embodiment. The system 500 is configured to be used within a hospital or clinical setting and may include similar components and systems used with the system 100 (FIG. 1) and the cyclotron 200 (FIGS. 2-6). The system 500 may include a cyclotron 502 and a target system 514 where radioisotopes are generated for use with a patient. The cyclotron 502 defines an acceleration chamber 533 where charged particles move along a predetermined path when the cyclotron 502 is activated. When in use, the cyclotron 502 accelerates charged particles along a predetermined or desired beam path 536 and directs the particles into a target array 532 of the target system 514. The beam path 536 extends from the acceleration chamber 533 into the target system 514 and is indicated as a hashed-line.

Figure 9:
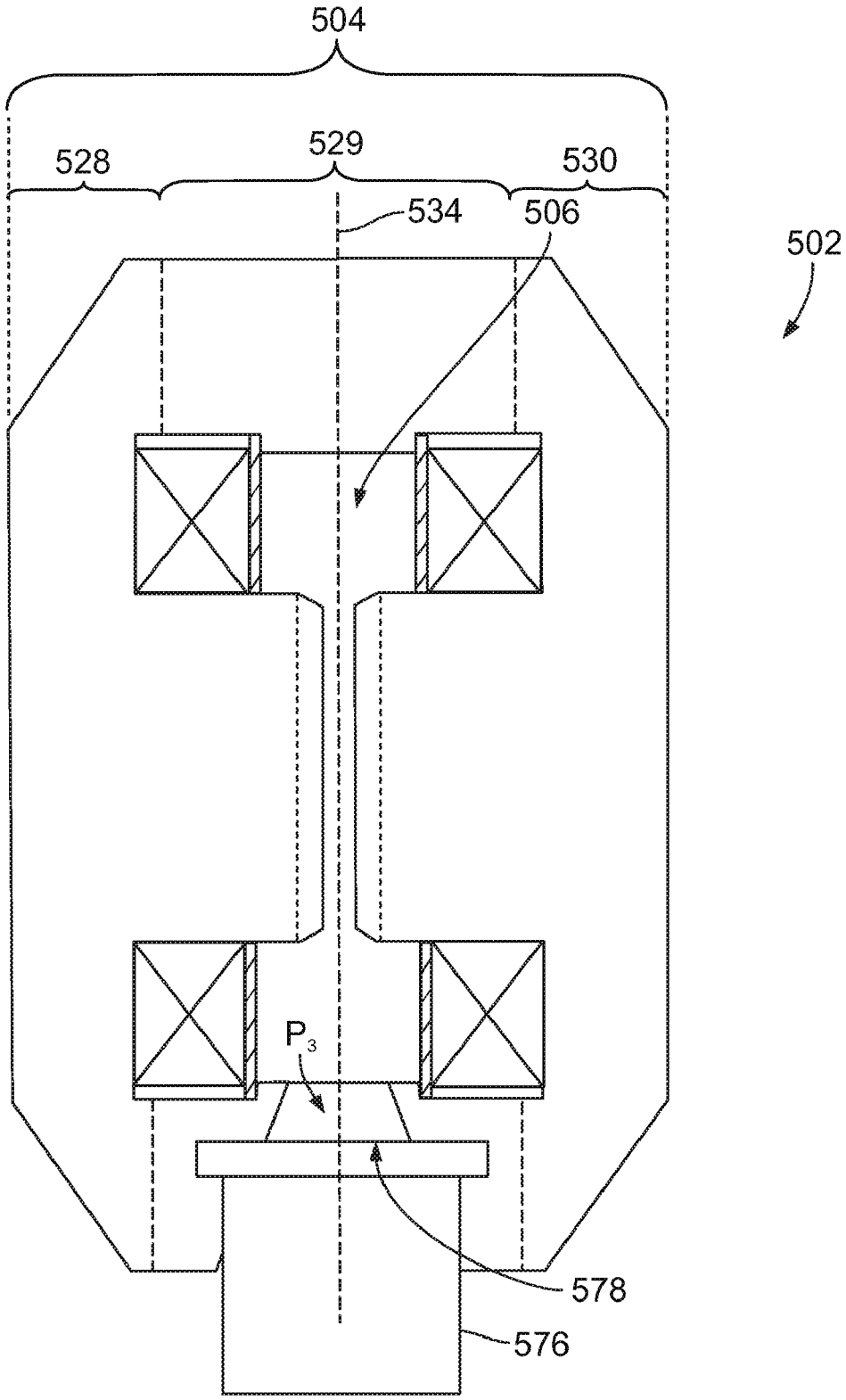
FIG. 9 is a side cross-section of an alternative cyclotron that may be used with the isotope production system shown in FIG. 6.

FIG. 9 is a cross-section of the cyclotron 502. As shown, the cyclotron 502 has similar features and components as the cyclotron 200 (FIG. 2). However, the cyclotron 502 includes a magnet yoke 504 that may comprise three sections 528-530 sandwiched together. More specifically, the cyclotron 502 includes a ring section 529 that is located between yoke sections 528 and 530. When the ring and yoke sections 528-530 are stacked together as shown, the yoke sections 528 and 530 face each other across a mid-plane 534 and define an acceleration chamber 506 of the magnet yoke 504 therein. As shown, the ring section 529 may define a passage $P_3$ that leads to a port 578 of a vacuum pump 576. The vacuum pump 576 may have similar features and components as the vacuum pump 276 (FIG. 2) and may be a turbomolecular pump, such as the turbomolecular pump 376 (FIG. 4).

Returning to FIG. 8, system 500 may include a shroud or housing 524 that includes moveable partitions 552 and 554 that open up to face each other. As shown in FIG. 8, both of the partitions 552 and 554 are in an open position. The housing 524 may comprise a material that facilitates shielding radiation. For example, the housing may comprise polyethylene and, optionally, lead. When closed, the partition 554 may cover the target array 532 and a user interface 558 of the target system 514. The partition 552 may cover the cyclotron 502 when closed.

Also shown, the yoke section 528 of the cyclotron 502 may be moveable between open and closed positions. (FIG. 8 illustrates an open position and FIG. 9 illustrates a closed position.) The yoke section 528 may be attached to a hinge (not shown) that allows the yoke section 528 to swing open like a door or a lid and provide access to the acceleration chamber 533. The yoke section 530 (FIG. 9) may also be moveable between open and closed positions or may be sealed to or integrally formed with the ring section 529 (FIG. 9).

Furthermore, the vacuum pump 576 may be located within a pump chamber 562 of the ring section 529 and the housing 524. The pump chamber 562 may be accessed when the partition 552 and the yoke section 528 are in the open position. As shown, the vacuum pump 576 is located below a central region 538 of the acceleration chamber 533 such that a vertical axis extending through a center of the port 578 from a horizontal support 520 would intersect the central region 538. Also shown, the yoke section 528 and ring section 529 may have a shield recess 560. The beam path 536 extends through the shield recess 560.

Embodiments described herein are not intended to be limited to generating radioisotopes for medical uses, but may also generate other isotopes and use other target materials. Furthermore, in the illustrated embodiment the cyclotron 200 is a vertically-oriented isochronous cyclotron. However, alternative embodiments may include other kinds of cyclotrons and other orientations (e.g., horizontal).

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A cyclotron, comprising:

a magnet yoke having a yoke body surrounding an acceleration chamber, the yoke body including opposing pole tops that have a space therebetween, the yoke body having an exterior surface that defines an envelope of the yoke body;

a magnet assembly to produce magnetic fields to direct charged particles along a desired path, the magnet assembly located in the acceleration chamber, the magnetic fields propagating through the acceleration chamber and within the magnet yoke, wherein a portion of the magnetic fields escapes outside of the magnet yoke as stray fields; and a vacuum pump coupled to the yoke body and at least partially located within the envelope, the vacuum pump configured to introduce a vacuum into the acceleration chamber.

2. The cyclotron of claim 1, wherein the magnet yoke is dimensioned such that the vacuum pump does not experience magnetic fields in excess of 75 Gauss when an average magnetic field between the pole tops is 1.0 Tesla.

3. The cyclotron of claim 1 wherein an average magnetic field between the pole tops when the cyclotron is used to produce radioisotopes is at least 1 Tesla.

4. The cyclotron of claim 1, wherein the yoke body forms a pump-acceptance (PA) cavity within the envelope that is fluidicly coupled to the acceleration chamber, the vacuum pump being positioned in the PA cavity.

5. The cyclotron of claim 4, wherein the vacuum pump is positioned entirely within the PA cavity.

6. The cyclotron of claim 1, wherein the vacuum pump is a turbo molecular pump.

7. The cyclotron in accordance with claim 1 wherein the vacuum pump is a turbomolecular pump that includes a rotating fan, the rotating fan being at least partially located within the envelope.

8. The cyclotron of claim 1, wherein at least a portion of the vacuum pump is within 650 mm of a geometric center of the yoke body.

9. The cyclotron of claim 8, wherein the vacuum pump includes a rotating fan, at least a portion of the rotating fan being within 650 mm of a geometric center of the yoke body.

10. The cyclotron of claim 1, wherein the vacuum pump is at a pump location and wherein the pump location does not experience magnetic fields in excess of 75 Gauss when the pump location is not magnetically shielded by a magnetic shield.

11. A cyclotron, comprising:

a magnet yoke having a yoke body surrounding an acceleration chamber, the yoke body including opposing pole tops that have a space therebetween;

a magnet assembly to produce magnetic fields to direct charged particles along a desired path, the magnet assembly located in the acceleration chamber, the magnetic fields propagating through the acceleration chamber and within the magnet yoke, wherein a portion of the magnetic fields escapes outside of the magnet yoke as stray fields; and a vacuum pump coupled to the yoke body, the vacuum pump configured to introduce a vacuum into the acceleration chamber, the vacuum pump being a fluidless pump having a rotating fan to produce the vacuum, wherein at least a portion of the rotating fan is within 650 mm of a geometric center of the yoke body and wherein the vacuum pump does not experience magnetic fields in excess of 75 Gauss when an average magnetic field between the pole tops is 1 Tesla.

12. The cyclotron of claim 11, wherein the magnet yoke is dimensioned such that the vacuum pump does not experience magnetic fields in excess of 50 Gauss when the average magnetic field between the pole tops is 1 Tesla.

13. The cyclotron of claim 11, wherein the yoke body forms a pump-acceptance (PA) cavity that is fluidicly coupled to the acceleration chamber, the vacuum pump being positioned in the PA cavity.

14. The cyclotron of claim 11, wherein the vacuum pump is a turbo molecular pump.

15. The cyclotron of claim 11, wherein the rotating fan does not experience magnetic fields in excess of 75 Gauss when the vacuum pump is without a magnetic shield between the vacuum pump and the magnet yoke.

16. An isotope production system comprising:

a magnet yoke having a yoke body surrounding an acceleration chamber, the yoke body including opposing pole tops that have a space therebetween;

a magnet assembly to produce magnetic fields to direct charged particles along a desired path, the magnet assembly located in the acceleration chamber, the magnetic fields propagating through the acceleration chamber and within the magnet yoke, wherein a portion of the magnetic fields escapes outside of the magnet yoke as stray fields, an average magnetic field between the pole tops during production of isotopes being at least 1 Tesla;

a vacuum pump coupled to the yoke body, the vacuum pump configured to introduce a vacuum into the acceleration chamber, wherein the magnet yoke is dimensioned such that the vacuum pump does not experience magnetic fields in excess of 75 Gauss during production of the isotopes, and wherein at least a portion of the vacuum pump is within 650 mm of a geometric center of the yoke body; and a target container positioned to receive the charged particles for generating the isotopes.

17. The system of claim 16, wherein the magnet yoke is dimensioned such that the vacuum pump does not experience magnetic fields in excess of 50 Gauss.

18. The system of claim 16, wherein the vacuum pump is a fluidless pump having a rotating fan to produce the vacuum, at least a portion of the rotating fan being within 650 mm of a geometric center of the yoke body.

19. The system of claim 16, wherein the vacuum pump is a turbo molecular pump.

20. The isotope production system of claim 16, wherein the isotope production system does not include a magnetic shield around the vacuum pump for reducing the magnetic fields experienced by the vacuum pump.

21. The isotope production system of claim 16, wherein the isotope production system is configured to operate at an energy of about 9.6 MeV or less during production of the isotopes.

22. The isotope production system of claim 16, wherein the isotope production system is configured to operate at a beam current of approximately 10-30 μA during production of the isotopes.

23. The isotope production system of claim 16, wherein the isotope production system generates positive ions during production of the isotopes and produces at least one of $^{18}F^-$ isotopes, $^{11}C$ isotopes, or $^{13}N$ isotopes.

24. The isotope production system of claim 16, wherein the yoke body forms a pump-acceptance (PA) cavity that is fluidicly coupled to the acceleration chamber, the vacuum pump being positioned in the PA cavity.

* * * * *